US007666262B2

(12) United States Patent
Brown et al.

(10) Patent No.: US 7,666,262 B2
(45) Date of Patent: Feb. 23, 2010

(54) PROCESS FOR CLEANING LARGE FORMAT OR GIANT SCREEN MOVIE SCREENS

(75) Inventors: Andrew Thomas Brown, League City, TX (US); Michael Anthony Quaranto, Clear Lake Shores, TX (US)

(73) Assignee: 1570 Cinema Services, LLC, League City, TX (US)

( * ) Notice: Subject to any disclaimer, the term of this patent is extended or adjusted under 35 U.S.C. 154(b) by 550 days.

(21) Appl. No.: 11/600,632

(22) Filed: Nov. 16, 2006

(65) Prior Publication Data

US 2007/0113869 A1 May 24, 2007

Related U.S. Application Data

(60) Provisional application No. 60/597,277, filed on Nov. 21, 2005.

(51) Int. Cl.
*B08B 1/00* (2006.01)

(52) U.S. Cl. ..... 134/6; 15/77

(58) Field of Classification Search ..... None
See application file for complete search history.

(56) References Cited

U.S. PATENT DOCUMENTS

| | | | | |
|---|---|---|---|---|
| 3,056,153 | A * | 10/1962 | Laughter, Sr. | 15/50.1 |
| 3,641,607 | A * | 2/1972 | Lemelson | 15/4 |
| 5,901,720 | A * | 5/1999 | Lange | 134/172 |
| 5,968,271 | A * | 10/1999 | Maxwell et al. | 118/671 |
| 6,375,755 | B1 | 4/2002 | Stuck | |
| 2006/0096050 | A1 * | 5/2006 | Simonette et al. | 15/103 |

* cited by examiner

*Primary Examiner*—Michael Kornakov
*Assistant Examiner*—Ryan Coleman
(74) *Attorney, Agent, or Firm*—John R Casperson

(57) ABSTRACT

This invention relates to cleaning large format movie screens, such as vinyl screens and painted screens. There are different variations of the basic concept of using a cleaning head, cables, pulleys, an upper mounting bracket and a winch. In one instance a track may be used instead of a cable. The winch is connected to the cleaning head using cables and is used to move the cleaning head vertically across the screen through pulleys and other arrangements.

17 Claims, 6 Drawing Sheets

PROCESS FOR CLEANING LARGE FORMAT OR GIANT SCREEN MOVIE SCREENS

CROSS REFERENCES TO RELATED APPLICATIONS

This application claims the benefit of U.S. Provisional Application No. 60/597,277 filed Nov. 21, 2005, the disclosure of which is herein incorporated by reference.

FIELD OF THE INVENTION

This invention relates to methods for cleaning large format or giant movie screens.

BACKGROUND OF THE INVENTION

Large format or giant screen movies are movies shot with film larger than the conventional 35 mm format. This includes, but is not limited to the following formats: 15-perf/70 mm, 10-perf/70 mm and 8-perf/70 mm. For the purposes associated with this invention, large format or giant screen movies that fall under the preceding formats require large format movie screens for most effective use Large format screens are generally not prone to the normal abuses associated with regular format movie screens due to their distance from the audience. Large format screens are further away and are usually sealed off from moviegoers, therefore most foreign objects (pop, popcorn, gummy bears, spit wads, etc.) are not able to reach the screen. Despite this protection, large format movie screens nevertheless require periodic cleaning to ensure proper light reflection and picture sharpness. Accumulated dust is the main deterrent to light reflection, sharpness, and clarity of picture. Screens develop a layer of dust that must be removed for optimal performance. However, if the screen is not cleaned in the correct manner, the dust will form streaks, which will yield results worse than a dim, evenly dusted, screen.

The problems associated with cleaning large format screens are a consequence of their extremely large size and precarious locations. It is nearly impossible to get any type of cleaning head to every square foot of the screen by conventional and inexpensive means. Poles that can reach upwards of 60 feet are too cumbersome to maneuver with consistent results, man lifts cannot be maneuvered into place because of theater floor arrangements, and scaffolding is prohibitively costly and time consuming.

Due to the extremely high cost of all types of large format movie screens, it is beneficial for theater owners to be able to clean them at regular intervals. This is far more cost-effective than replacing them when they become too dirty.

Therefore, a method is needed to cover the entire screen in a systematic process, in order to achieve even cleaning.

OBJECT OF THE INVENTION

It is an object of this invention to provide a method of cleaning a large format movie screen that is effective and can be carried out within the confines of where the screen is placed.

SUMMARY OF THE INVENTION

One embodiment of the invention provides a method of cleaning a front side of a large format movie screen. A cleaning head is positioned against the front side of the screen so that a least a portion of the cleaning head is vertically aligned with a selected portion of the front side of the screen to be cleaned. The cleaning head is then moved vertically up and down against the selected portion with a winch system to clean the selected portion. The cleaning head is then repositioned against the screen so that at least a portion of the cleaning head is vertically aligned with an additional portion of the screen to be cleaned. The cleaning head is then moved up and down against the additional portion of the screen to clean the additional portion of the screen. The last two steps are repeated until the entire screen has been cleaned.

BRIEF DESCRIPTION OF THE DRAWINGS

The following drawings can be understood by reference to the Detailed Description of the Invention, wherein.

DETAILED DESCRIPTION OF THE INVENTION

Figure 1:
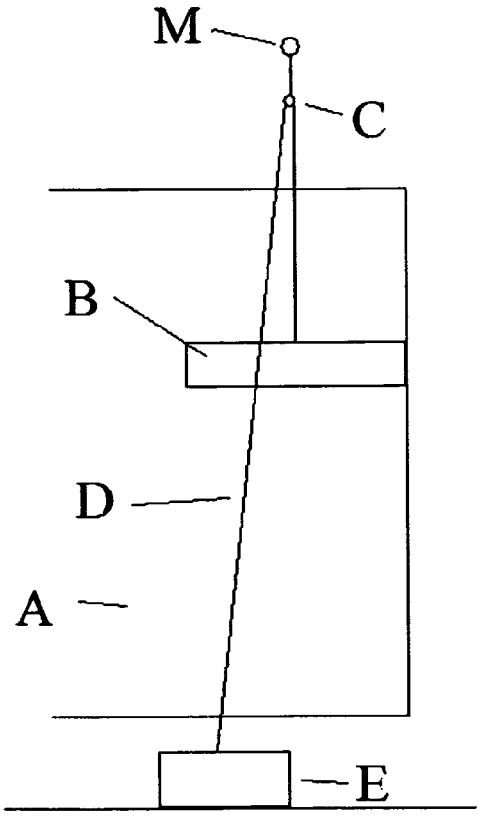
FIGS. 1 and 2 schematically illustrate outrigger pole positioning as viewed from a front side of the screen.

One embodiment of the invention provides a method of cleaning a front side of a large format movie screen. A cleaning head is positioned against the front side of the screen so that a least a portion of the cleaning head is vertically aligned with a selected portion of the front side of the screen to be cleaned. The cleaning head is then moved vertically up and down against the selected portion with a pulley system to clean the selected portion. The cleaning head is then repositioned against the screen so that at least a portion of the cleaning head is vertically aligned with an additional portion of the screen to be cleaned. The cleaning head is then moved up and down against the additional portion of the screen to clean the additional portion of the screen. The last two steps are repeated until the entire screen has been cleaned.

Preferably, the additional portion overlaps with the selected portion, and the repeated steps are carried out to clean overlapping portions of the screen. Gravity is preferably used in conjunction with the winch system to urge the cleaning head against the screen, although the cleaning head can be track mounted if desired. A pulley is provided above the upper end of the screen and is spaced a first distance in front of the front side of the screen in one embodiment of the invention. At least one cable mounting point is provided on the cleaning head a second distance in front of the front side of the screen.

These distances are selected so that the cleaning head swings into contact with the screen with enough force to adequately effect cleaning.

The invention is preferably carried out in conjunction with a cable reel, which is most preferably part of a powered winch system. In multiple embodiments, the cable runs from the reel, through the pulley and is attached to the cleaning head. It is moved up and down by rotation of the cable reel.

One way to achieve effective spacing of the pulley is to position a pole across the upper end of the screen. The pole extends from a backside of the screen to the front side and has a front end portion extending in front of the screen and a back end portion extending behind the screen. The pulley is attached to the front portion of the pole. A mid portion of the pole is preferably mounted in a suitable mounting fixture, which is attached to suitable support structure, for example part of the scaffolding frame, roof frame or screen frame, or on the upper end of the screen itself. The back end portion of the pole is then tied down to counterbalance the forces acting on the front end portion, for example, to a portion of a frame behind the screen, or to a dead weight positioned on the floor or the scaffolding structure.

As the cleaning head is repositioned to clean new portions of the screen, the mounting fixture has to be moved, as well as the tie-down point on the aft end of the pole. If possible, it is advantageous to employ a mounting fixture comprising a saddle base to rest on the upper end of the screen, since it doesn't require unfastening in order to be moved, although a clamping base which clamps onto the building, screen or scaffolding frame can be used with good results.

Most preferably, the cable reel forms part of a power winch assembly, and the cleaning head is moving up and down by powering the winch assembly. A reversible electric winch system provides good results. The cable can be selected from the group consisting of steel cable, synthetic cable and chain, for example, and the winch assembly can be powered by a motive source selected from the group consisting of electricity, gasoline and manual operation.

A wide variety of cleaning heads can be employed. For example, cleaning heads selected from the group consisting of a soft brush, a vacuum, a soft brush and a vacuum, and a dust attracting static electricity head are all expected to provide desirable results, depending on circumstances.

In one embodiment of the invention, the cleaning head is carried on a cleaning unit comprising opposed first and second cleaning heads. The opposed heads are both carried by a connecting frame. The cable mounting point is on the connecting frame. The cleaning unit can be reoriented from a position in which the first cleaning head contacts the screen to a position in which the second cleaning head contacts the screen. This permits rapid changeover from use of a cleaning head that is more effective for coarse dust, to one that is more effective for fine dust, for example. It can be further desirable to be able to quickly replace cleaning media which is not of a type which is easily cleaned. Therefore, in one embodiment, at least one of the cleaning heads preferably comprises a releasable layer of cleaning media, and the method further comprises replacing the releasable layer of cleaning media.

It is within the scope of one embodiment of the invention to utilize a vertical track in front of the screen. The cleaning head is then mounted to the track in order to be carried up and down. Because of the great heights involved, and the typically limited work areas in front of the screen, it is desirable to secure at least the upper end of the track, most preferably at a position above the upper end of the screen. A pole system as described herein is expected to provide good results.

Additional Description of Preferred Embodiments

The process we have invented uses a cable or a track mount in front of, and above the screen with a cleaning head attached to the cable or track. The cleaning head can be anything that effectively cleans dust, stains or foreign objects from the screen. In all variations the cleaning head is moved in a vertical direction.

The steps involved when using a cable consist of: making a mount in front of and above the screen, using the mount to attach pulleys or a direct cable to the cleaning head, using the power of a winch to move the cleaning head up and down, and moving the mount horizontally in order to clean a new vertical strip of the screen.

The steps involved when using a track consist of: setting up a vertical track in front of the screen, attaching a cleaning head to the track, using the power of a winch to move the cleaning head up and down, and moving the track horizontally in order to clean a new vertical strip of the screen.

Going over the screen more than once in the same spot may be needed for effective cleaning.

Figure 2:
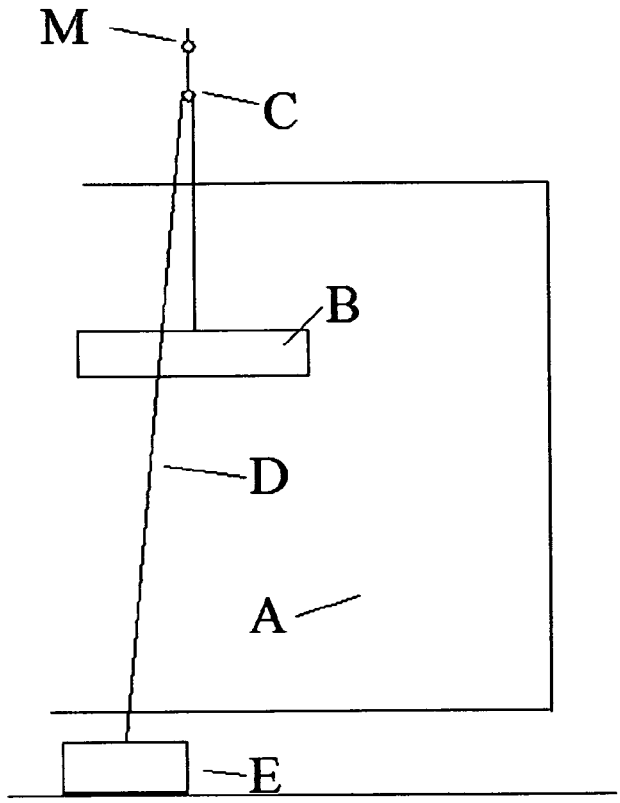

FIGS. 1 and 2 display certain features of an outrigger pole (M) located above and in front of the screen (A). All of the embodiments mentioned utilize an outrigger pole (M). The outrigger pole must be able to easily hold the weight of the cleaning head (B), any cables used (D), rigging (C), winch (E) (if applicable) and any other device hanging in front of the screen. It must also be able to securely fasten the top part of the track mechanism (if applicable). The mounting bracket and outrigger pole must also be moveable as to allow the cleaning head to be moved horizontally once a cleaning pass has been made. After a pass has been made, and the operator finds that section of the screen sufficiently clean, the mounting bracket and outrigger pole should be repositioned over a portion of the screen that has not been cleaned (FIG. 2). Overlapping a portion of the screen that has been cleaned is a good idea to avoid dust lines and streaking. The cleaning head needs to be aligned with the outrigger pole. This can be done by making sure the cleaning head is directly below the outrigger pole at the top of the screen. The cleaning head will move vertically directly below wherever the mount is installed regardless of winch position. However, the winch should still be moved to align with the cleaning head if possible.

Figure 3:
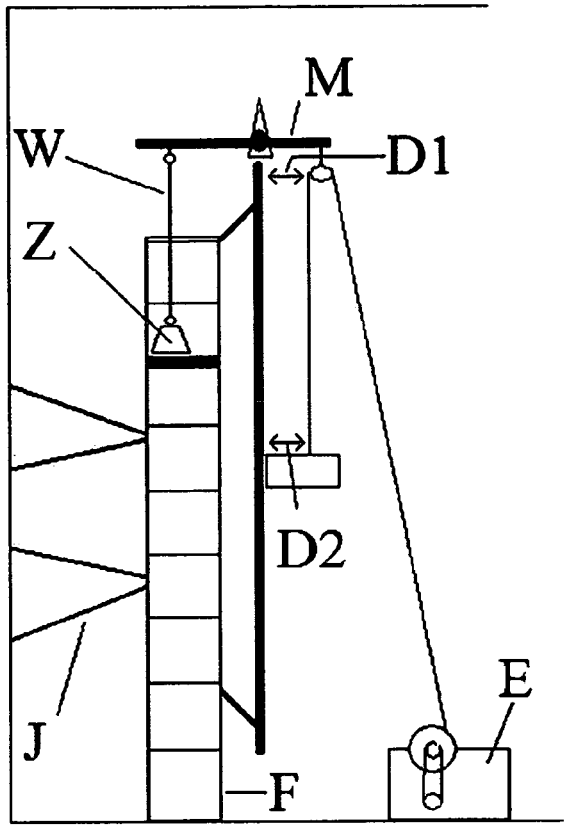
FIGS. 3 and 4 schematically illustrate two embodiments of the invention from a side view of entire assembly FIGS. 5 and 6 schematically illustrate portions of the invention as shown in FIGS. 3 and 4 in greater detail.
Figure 4:
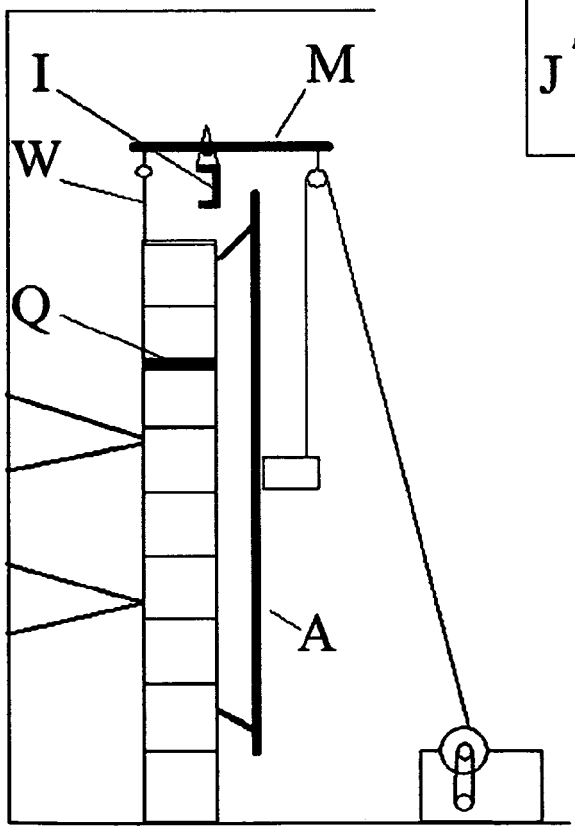

FIGS. 3 and 4 depict behind screen features of a large format movie screen. In order for the outrigger pole (M) to be installed, it is best for a person to utilize the catwalk (Q) set up on top of the scaffolding (F). The operator must climb the rear scaffolding (F) behind the screen to reach the catwalk (Q). Safety is vital during this part of the process and a helmet as well as a safety rope and harness must be utilized. The rear scaffolding (F) is attached to the back wall of the theater by a series of braces (J). Due to the custom nature of large format movie screens, operators could encounter a number of different riggings and configurations at the top of the screen (A). In FIG. 3, the distance D1 between the front side of the screen and the pulley is preferably less than the distance D2 between the front side of the screen and the mounting point on the cleaning head, so that the cleaning head swings against the screen due to gravity to facilitate the cleaning steps.

Figure 5:
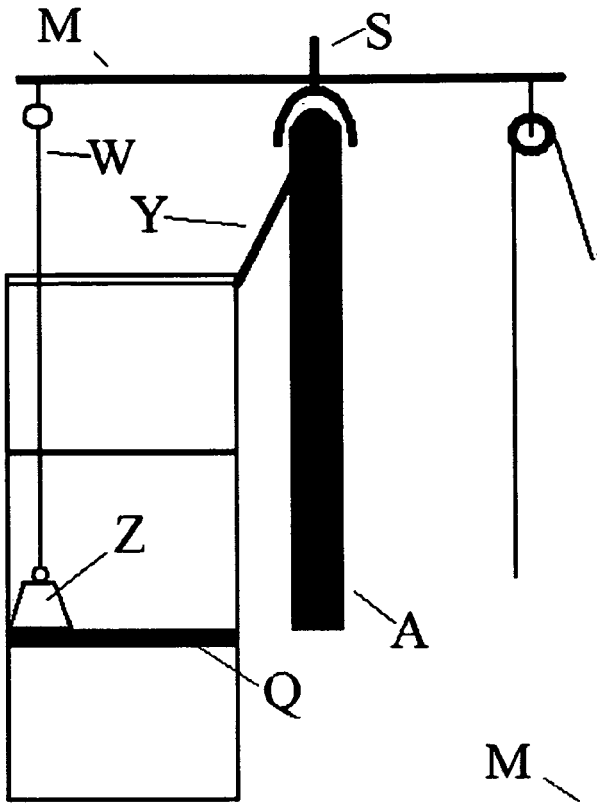
Figure 6:
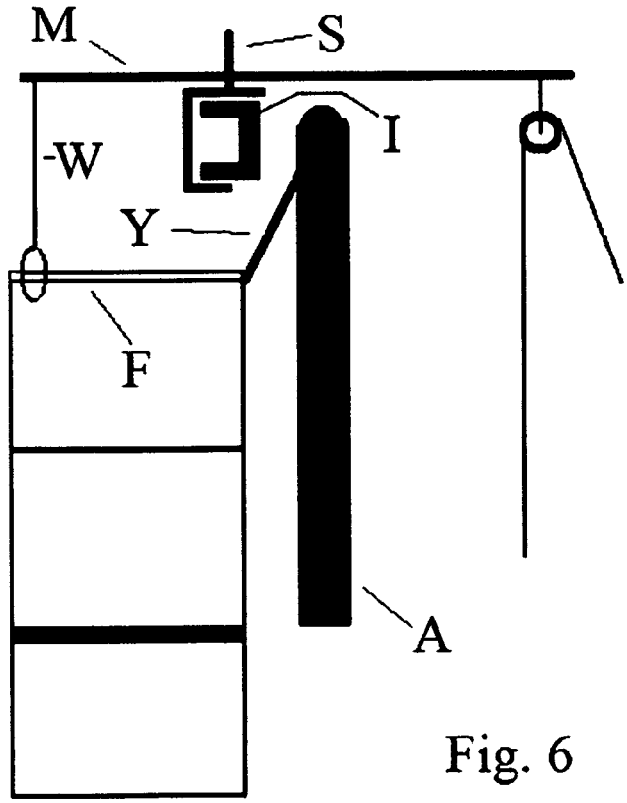

FIGS. 5 and 6 show in more detail what the rigging at the top of the screen looks like. Because all screens have different configurations, it is important that every screen is surveyed and a custom mounting bracket (S) be constructed for every screen before the official cleaning visit. Some screens, as in FIG. 6, have a beam (I) located behind and above the screen. If this is the case then the mounting bracket (S), which holds the outrigger pole (M), needs to be able to fit on the beam (I). If a beam is not installed, as in FIG. 5, then the mounting bracket (S) needs to be curved and padded to be able to fit directly on top of the screen (A). In any case, the mounting bracket acts as a pivot point for the outrigger pole. In order to counter act the weight of the cleaning head, a strap (W) must be used. This strap can be anything adjustable enough to make the outrigger pole perpendicular to the screen. The strap can be chain, rope or a piece of webbing that is attached to the scaffolding (F) or a weight (Z) in order to counter act the weight of the cleaning head. Bracket (Y) is simply a mounting bracket which suspends the screen, and is not used in our application.

The winch mechanism used in all of the embodiments is simply a device powered by electrical, human, or gas power. It contains a spool used to reel in and contain cable and provides the means necessary to move the cleaning head vertically across the screen.

Figure 7:
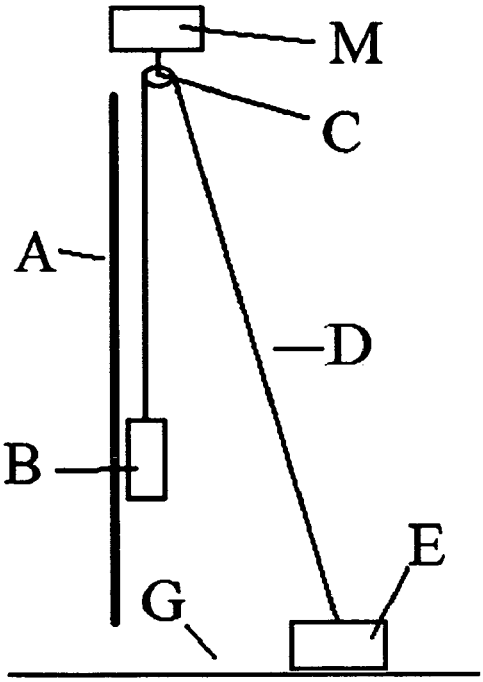
FIG. 7 schematically illustrates a floor-mounted winch-cleaning assembly in accordance with an embodiment of the invention.

In the FIG. 7 embodiment the winch (E) is positioned on the floor (G) in front of the screen (A). The winch is used to reel in cable (D), which is run up and over a pulley (C) and then down to the cleaning head (B). The pulley is attached to the outrigger pole (M) located above and in front of the screen. An operator must be positioned at the top in order to reposition the mounting bracket horizontally. An operator must also be positioned on the floor to control the vertical motion of the winch and the horizontal repositioning of the cleaning head.

Figure 8:
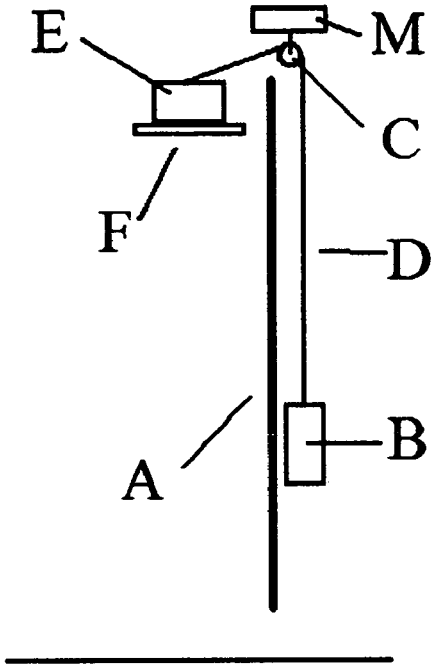
FIG. 8 schematically illustrates a scaffolding mounted winch-cleaning assembly in accordance with an embodiment of the invention.

In the FIG. 8 embodiment the winch (E) is positioned on the scaffolding (F) behind the screen (A). The winch is used to reel in cable (D), which is run up and over a pulley (C) and then down to the cleaning head (B). The pulley must attach to the outrigger pole (M) above and in front of the screen. An operator must be positioned at the top in order to control the winch, reposition the mounting bracket horizontally, move the winch horizontally and move the cleaning head over a portion of the screen that hasn't been cleaned. An operator must also be positioned on the floor to monitor the cleaning head and make sure it doesn't get caught on the bottom of the screen.

Figure 9:
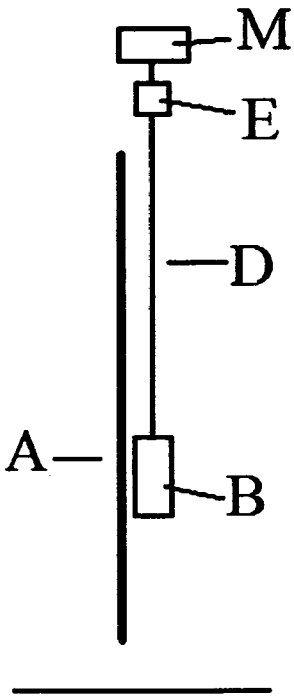
FIG. 9 schematically illustrates a hanging winch-cleaning assembly in accordance with an embodiment of the invention.

In the FIG. 9 embodiment the winch (E) is mounted on the outrigger pole (M) located in front of and above the screen (A). The winch is used to reel in the cable (D), which is attached to the cleaning head (B). An operator must be positioned at the top in order to control the winch, reposition the mounting bracket horizontally, move the winch horizontally and move the cleaning head over a portion of the screen that hasn't been cleaned. An operator must also be positioned on the floor to monitor the cleaning head and make sure it doesn't get caught on the bottom of the screen.

Figure 10:
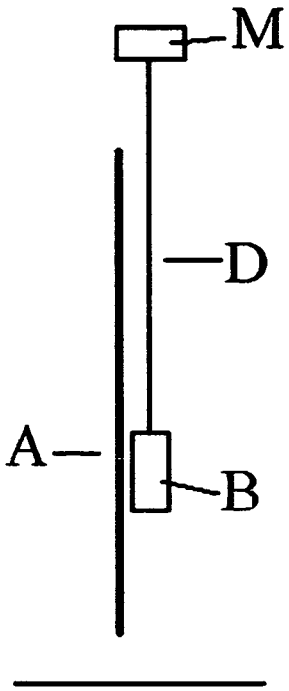
FIG. 10 schematically illustrates an integrated head and winch cleaning assembly in accordance with an embodiment of the invention.

In the FIG. 10 embodiment the winch is integrated into the cleaning head (B). The cleaning head is attached to a cable (D). The cable is attached to the outrigger pole (M) located above and in front of the screen (A). An operator must be positioned at the top in order to reposition the mounting bracket horizontally, and move the cleaning head over a portion of the screen that hasn't been cleaned. An operator must also be positioned on the floor to monitor the cleaning head and make sure it doesn't get caught on the bottom of the screen.

Figure 11:
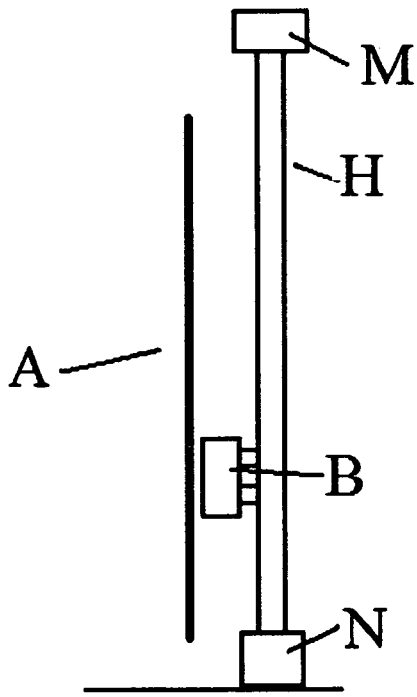
FIG. 11 schematically illustrates a track-mounted cleaning assembly in accordance with an embodiment of the invention.

In the FIG. 11 embodiment the cleaning head (B) is mounted on a track (H), which is positioned in front of the screen (A). An upper mount (M) and lower mount (N) are used to secure the track. A winch can be used in this embodiment as it is in FIGS. 3-7 to move the cleaning head vertically across the screen.

Figure 12:
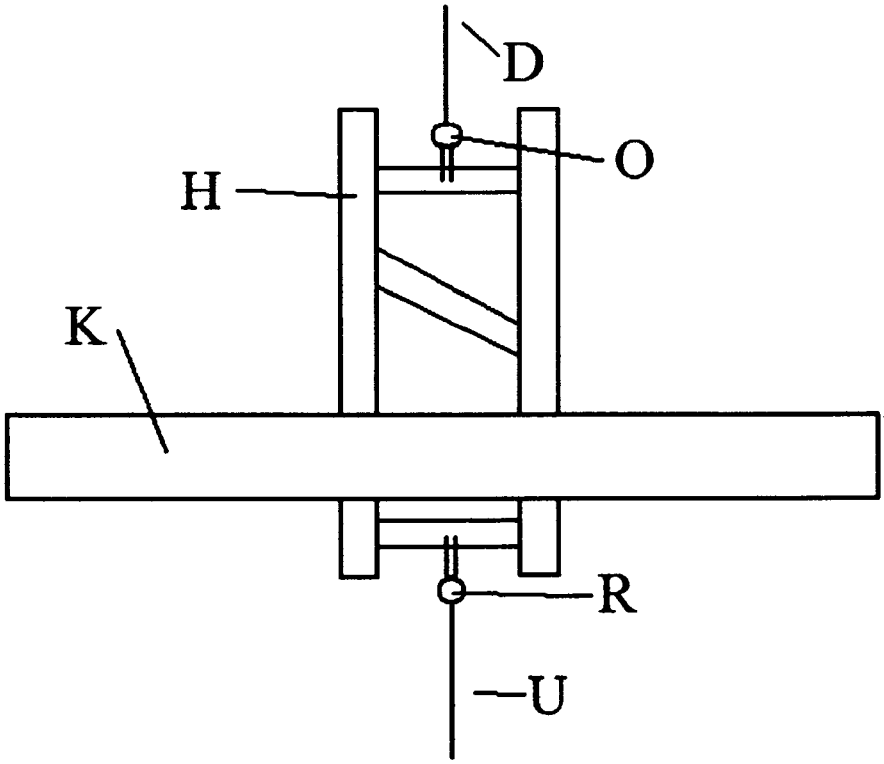
FIG. 12 schematically illustrates back view of a cleaning unit in accordance with an embodiment of the invention.
Figure 13:
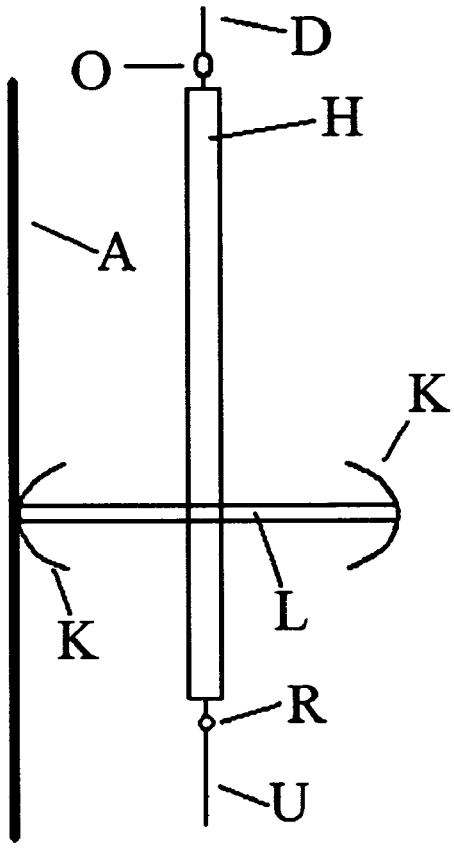
FIG. 13 schematically illustrates a side view of the cleaning unit as shown in FIG. 12.
Figure 14:
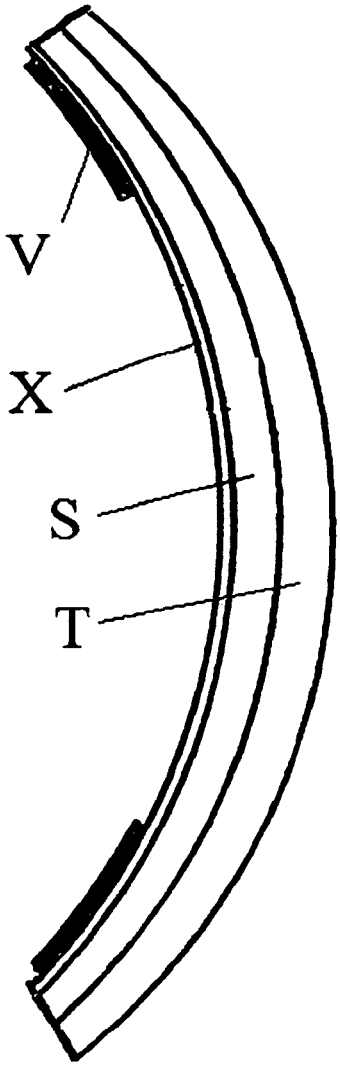
FIG. 14 schematically illustrates a portion of the cleaning unit shown in FIG. 13 in greater detail.

FIGS. 12, 13 and 14 give a more detailed description of the type of cleaning unit used in the preferred embodiment. The cleaning unit consists of a frame (H), which holds the extension arms (L), which hold the cleaning heads (K). The backbone (H) is made out of aluminum for lightness and is about 3 feet tall and 6 inches wide. It has an eyebolt (O) at the top to connect to the drive cable (D). The eyebolt on the bottom (R) is used to connect to a guide rope (U), the guide rope may be needed at times to manually move the cleaning head over parts of the screen that would be hard to maneuver the outrigger pole over. The guide rope can also be used to hold the cleaning unit on the screen if the curvature is such that gravity pulls the cleaning unit away from the screen instead of toward it. The frame holds an extension arm (L), which can be seen in FIG. 13. The extension arms are made out of aluminum and hold the cleaning heads (K) about 6 inches away from the frame. This cleaning unit has two cleaning heads. The two cleaning head system works well because you can attach two different types of cleaning media to the cleaning heads for a more thorough cleaning. You simply have to flip the cleaning unit and put the preferred cleaning head (K) on the screen (A). The cleaning head (K) is screwed to the extension arms and is usually about 5 feet wide. It is made out of 3" PVC pipe and cut into thirds so that it is not round. FIG. 14 shows in greater detail a portion of the cleaning head (K). Glued to the top of the cleaning head is foam or another soft medium (S), which provides padding. On top of this medium is the cleaning material (T). This is usually micro-fiber or lambs wool but can be any material that removes dust and other contaminants. If the cleaning material is cleanable while attached to the cleaning head (Lambs wool) then it can be permanently attached to the soft medium (S). If the cleaning material needs to be replaced frequently, such as micro-fiber, it is suggested that Velcro (R) brand fasteners (V) be attached to the back of the cleaning head in order to hold the micro-fiber in place. In the preferred embodiment one of the cleaning heads is lamb's wool in order to remove coarse dust while the other side is micro-fiber in order to remove fine dust.

The invention stated is described to be as broad as possible and any variations of the basic concepts mentioned should be included in the general scope of this invention. While certain preferred embodiments of the invention have been described herein, the invention is not to be construed as being so limited, except to the extent that such limitations are found in the claims.

What is claimed is:

1. A method of cleaning a front side of a large format movie screen, comprising the steps of a) positioning a cleaning head against the front side of the screen so that a least a portion of the cleaning head is vertically aligned with a selected portion of the front side of the screen to be cleaned, b) moving the cleaning head vertically up and down against the selected portion with a winch system to clean the selected portion, c) repositioning the cleaning head against the screen so that at least a portion of the cleaning head is vertically aligned with an additional portion of the screen to be cleaned, d) moving the cleaning head up and down against the additional portion of the screen to clean the additional portion of the screen, e) repeating steps c) and d) until the entire screen has been cleaned, wherein the additional portion overlaps with the selected portion, and steps c) and d) are carried out to clean overlapping portions of the screen, a single pulley is provided above an upper end of the screen, said pulley being spaced a first distance in front of the front side of the screen, a single cable mounting point is provided on the cleaning head, said cable mounting point being a second distance in front of the front side of the screen, a cable connects the single pulley with the single cable mounting point, and said first distance and said second distance are selected so that gravity urges the cleaning head against the screen adequately to effect cleaning.

2. A method as in claim 1, further comprising providing a cable reel, and providing the cable running from the reel, through the pulley, and to the cleaning head at the single mounting point, wherein the cleaning head is moved up and down by rotating the cable reel.

3. A method as in claim 2, further comprising positioning a pole across the upper end of the screen, said pole extending from a back side of the screen to the front side and having a front end portion extending in front of the screen and a back end portion extending behind the screen, and positioning the pulley on the front-end portion of the pole.

4. A method as in claim 3 wherein the pole further comprises a mid portion, said method further comprising positioning the mid portion of the pole in a mounting fixture.

5. A method as in claim 4 further comprising attaching the mounting fixture to suitable support structure.

6. A method as in claim 5 further comprising tying down the back end portion of the pole so that the pole extends perpendicular to the screen.

7. A method as in claim 6 further comprising moving the mounting fixture to effect the horizontal repositioning of the cleaning head against the screen.

8. A method as in claim 5 wherein the suitable support structure comprises the upper end of the screen and the mounting fixture comprises a padded saddle base to rest on the upper end of the screen.

9. A method as in claim 5 wherein the suitable support structure comprises a frame behind the screen and the mounting fixture comprises a clamping base for clamping onto the frame.

10. A method as in claim 7 wherein the back end portion of the pole is tied down to a portion of a frame behind the screen.

11. A method as in claim 7 wherein the back end portion of the pole is tied down to a dead weight having adequate mass to counterbalance downward forces on the front end portion of the pole.

12. A method as in claim 2 wherein the cable reel forms part of a power winch assembly, and the cleaning head is moved up and down by powering the winch assembly.

13. A method as in claim 12, wherein the cable is selected from the group consisting of steel cable, synthetic cable and chain, and the winch assembly is powered by a motive source selected from the group consisting of electricity, gasoline and manual operation.

14. A method as in claim 12 wherein the cleaning head comprises a dust attracting static electricity head.

15. A method as in claim 12, wherein the cable is synthetic cable said method further comprising connecting a guide rope to the cleaning head and employing the guide rope to manually move the cleaning head over parts of the screen that would be hard to position the outrigger pole over.

16. A method as in claim 1, further comprising carrying the cleaning head on a cleaning unit comprising opposed first and second cleaning heads and a connecting frame, the cable mounting point being positioned on the connecting frame, and reorienting the cleaning unit from a position in which the first cleaning head contacts the screen to a position in which the second cleaning head contacts the screen.

17. A method as in claim 2 wherein the cleaning head comprises lamb's wool, said method further comprising cleaning the lamb's wool while it is attached to the cleaning head.

* * * * *